US010507669B2

(12) United States Patent
Saga

(10) Patent No.: US 10,507,669 B2
(45) Date of Patent: Dec. 17, 2019

(54) PRINTER

(71) Applicant: TOSHIBA TEC KABUSHIKI KAISHA, Tokyo (JP)

(72) Inventor: Kengo Saga, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/033,498

(22) Filed: Jul. 12, 2018

(65) Prior Publication Data

US 2019/0023024 A1 Jan. 24, 2019

(30) Foreign Application Priority Data

Jul. 21, 2017 (JP) ..... 2017-141973

(51) Int. Cl.

| | |
|---|---|
| ***B41J 2/36*** | (2006.01) |
| ***B41J 2/355*** | (2006.01) |
| ***B41J 2/335*** | (2006.01) |
| ***B41J 3/407*** | (2006.01) |
| ***B41J 13/00*** | (2006.01) |

(Continued)

(52) U.S. Cl.

CPC ..... *B41J 2/355* (2013.01); *B41J 2/335* (2013.01); *B41J 2/36* (2013.01); *B41J 3/4075* (2013.01); *B41J 11/42* (2013.01); *B41J 13/0009* (2013.01); *B41J 2002/0052* (2013.01)

(58) Field of Classification Search

CPC ..... B41J 2/355; B41J 11/42; B41J 2/36; B41J 2/335; B41J 3/4075; B41J 13/0009; B41J 2002/0052

See application file for complete search history.

(56) References Cited

U.S. PATENT DOCUMENTS 7,461,917 B2 * 12/2008 Fogarty ..... B41J 3/01 347/107

7,839,425 B2 11/2010 Morrison (Continued)

FOREIGN PATENT DOCUMENTS

EP 2133208 A2 12/2009

EP 2165839 A1 3/2010

(Continued)

OTHER PUBLICATIONS

Extended European Search Report dated Dec. 10, 2018, filed in counterpart European Patent Application No. 18184101.6, 9 pages.

*Primary Examiner* — Huan H Tran

(74) *Attorney, Agent, or Firm* — Kim & Stewart LLP

(57) ABSTRACT

A printer includes a thermal head having a plurality of heating elements to print on a paper that is conveyed thereto, a controller configured to control a speed of the paper that is conveyed and an amount of power supplied to the heating elements, and a processor configured to determine from image data of an image that is to be printed on the paper using the thermal head whether or not a character and a figure other than the character are to be simultaneously printed and instruct the controller based on the determination. The processor instructs the controller to set the speed of the paper to a first speed which is slower than a second speed, which is the speed for printing the character without the figure, upon determining that the character and the figure are to be simultaneously printed.

20 Claims, 6 Drawing Sheets

(51) Int. Cl.
*B41J 11/42* (2006.01)
*B41J 2/005* (2006.01)

(56) References Cited

U.S. PATENT DOCUMENTS

| | | | | |
|---|---|---|---|---|
| 8,035,672 | B2 * | 10/2011 | Matsuda | B41J 2/355<br>347/188 |
| 8,179,409 | B2 | 5/2012 | Saga | |
| 8,314,821 | B2 | 11/2012 | Morrison | |
| 8,638,351 | B2 | 1/2014 | Yamada et al. | |
| 2016/0107459 | A1 | 4/2016 | Sato et al. | |

FOREIGN PATENT DOCUMENTS

| | | | |
|---|---|---|---|
| EP | 2497644 | A1 | 9/2012 |
| JP | S63230345 | A | 9/1988 |
| JP | 2012-66473 | A | 4/2012 |

* cited by examiner

FIG. 4
342
| 3421 | 3422 |
| --- | --- |
| CONSTANT SPEED 1 (4IPS) | ENERGIZATION TIME (T1) |
| CONSTANT SPEED 2 (2IPS) | ENERGIZATION TIME (T2) |
FIG. 5
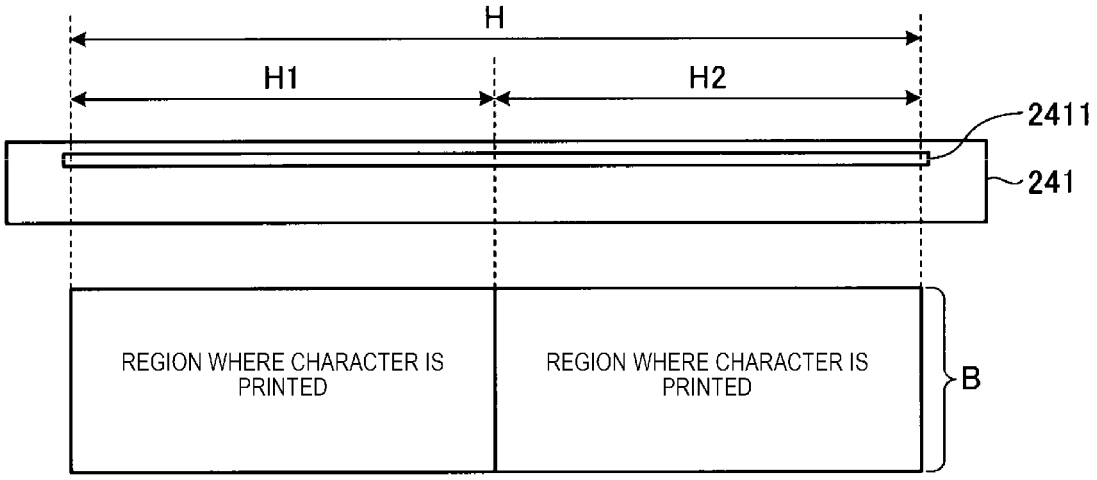
FIG. 6
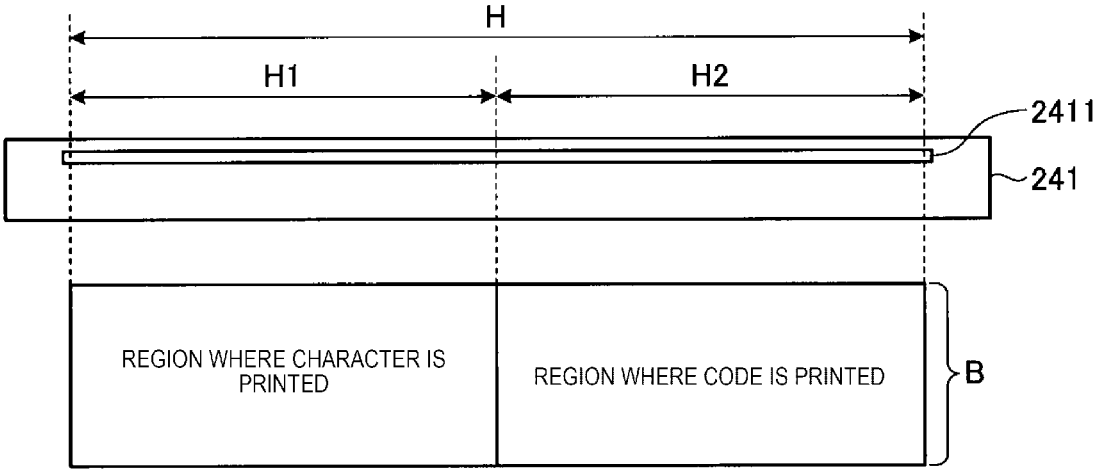

PRINTER

CROSS-REFERENCE TO RELATED APPLICATION

This application is based upon and claims the benefit of priority from Japanese Patent Application No. 2017-141973, filed Jul. 21, 2017, the entire contents of which are incorporated herein by reference.

FIELD

Embodiments described herein relate generally to a printer.

BACKGROUND

In the related art, a printer, such as a receipt printer, a portable printer, and a label printer for printing a label, which may be mounted on or connected to a point of sales (POS) terminal that processes a sales registration of a purchased commodity, often uses a thermal printer having a line thermal head, which transfers heat using the line thermal head while conveying a thermal paper (hereinafter, referred to as "paper") to develop color on the thermal paper. These printers perform printing by increasing a conveying speed of a paper at high speed as much as possible.

If a character, a number, a symbol, or the like (hereinafter, collectively referred to as "characters") is printed, by the thermal printer, on the paper, the character generally can be formed accurately and read even if high-speed printing is performed. However, if a code such as a bar code and a two-dimensional code and a pattern such as a logo and a coupon (hereinafter, code and pattern are collectively referred to as "figure") are printed and high-speed printing is performed, "tailing" phenomenon may occur in which unintentional printing is caused due to residual heat accumulated in the head. If such a phenomenon occurs, for example, the printed code including the tailing may not be read correctly, or a gradation of the figure may not be properly printed out.

Therefore, if printing of an image including the figure is performed, printing is no longer performed at a high speed, and instead performed at a low speed.

However, if printing of an image including a figure and characters is performed and the figure and characters are simultaneously printed by the line thermal head, the conveying speed is set to be low because of the presence of the figure. Therefore, for simultaneous printing of the figure and characters, electric power consumed for printing of the character is larger than necessary.

DESCRIPTION OF THE DRAWINGS

FIG. 4 is a memory map illustrating a portion of a memory configuration of the printer.

FIG. 5 is an explanatory diagram illustrating a structure of a thermal head and a printing region.

FIG. 6 is another explanatory diagram illustrating the structure of the thermal head and the printing region.

DETAILED DESCRIPTION

Embodiments provide a printer capable of suppressing the amount of electric power used for printing to a low level if characters and a figure are simultaneously printed.

A printer according to an embodiment includes a thermal head having a plurality of heating elements to print on a paper that is conveyed thereto, a controller configured to control a speed of the paper that is conveyed and an amount of power supplied to the heating elements, and a processor configured to determine from image data of an image that is to be printed on the paper using the thermal head whether or not a character and a figure other than the character are to be simultaneously printed and instruct the controller based on the determination. The processor instructs the controller to set the speed of the paper to a first speed which is slower than a second speed, which is the speed for printing the character without the figure, upon determining that the character and the figure are to be simultaneously printed.

Hereinafter, an embodiment will be described in detail with reference to the drawings. A printer mounted on a POS terminal will be described as an example of the printer. The embodiment is not limited by the embodiment described below.

The POS terminal is installed in a store and performs sales registration processing and settlement processing of a commodity sold at the store. The sales registration processing is processing of optically reading a code represented by a symbol such as a bar code or a two-dimensional code attached to the commodity to be sold, acquiring a commodity code specifying the commodity, displaying commodity information (e.g., commodity name, price, and the like) read out based on the acquired commodity code, and storing the commodity information in a RAM or the like in a transaction with a customer. The settlement processing is processing of displaying the total amount relating to the transaction, processing of calculating and displaying a change based on a deposit received from the customer, and processing of instructing a changer to issue the change, based on the commodity information stored in the RAM or the like in association with the sales registration processing. The commodity information and settlement information (e.g., total amount, deposit amount, change amount, and the like) after the settlement processing are issued as a receipt printed by the printer.

Figure 1:
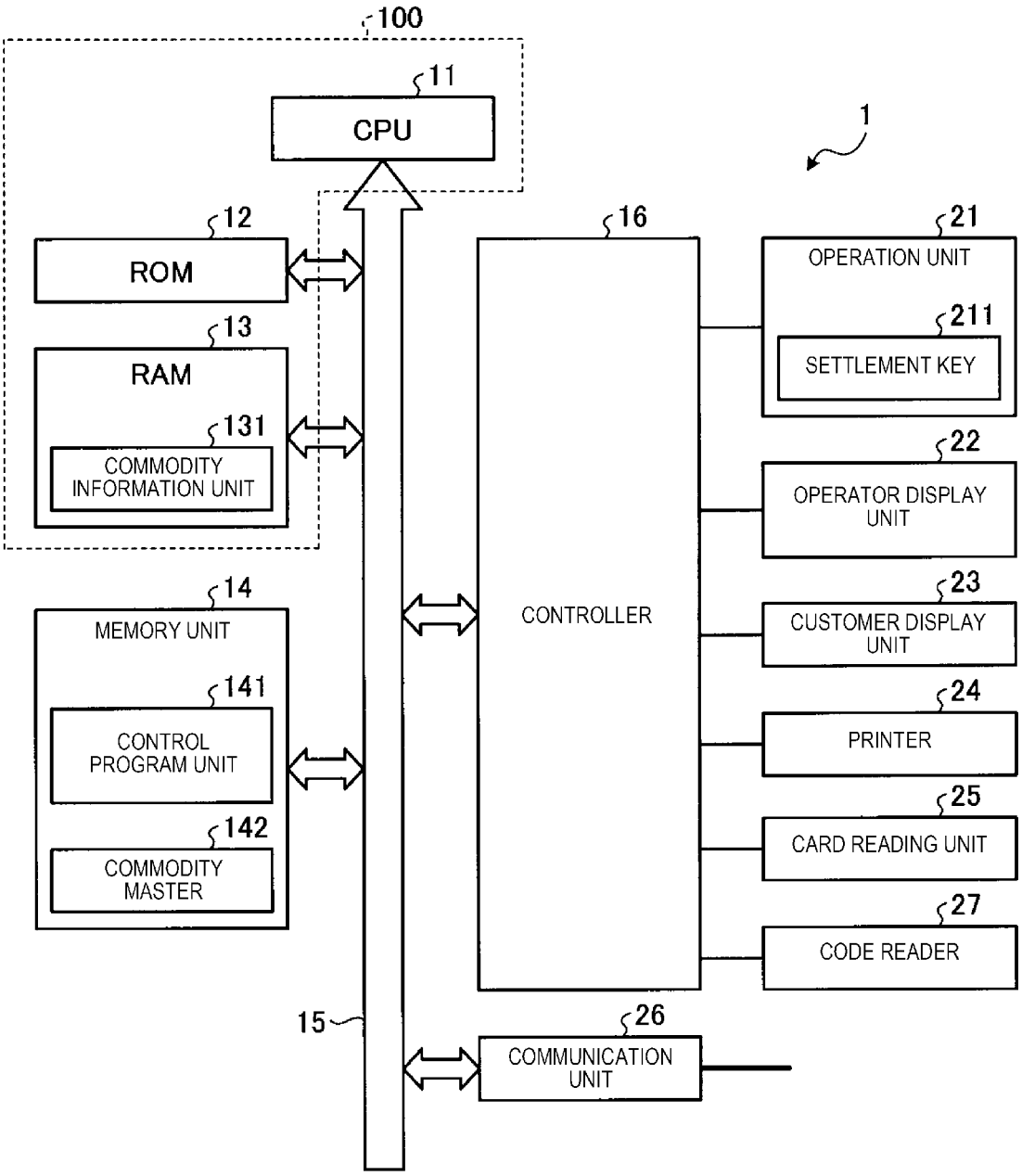
FIG. 1 is a block diagram illustrating a hardware configuration of a POS terminal according to an embodiment.

Next, a hardware configuration of a POS terminal 1 will be described. FIG. 1 is a block diagram illustrating the hardware configuration of the POS terminal 1. As illustrated in FIG. 1, the POS terminal 1 is provided with a central processing unit (CPU) 11, a read only memory (ROM) 12, a random access memory (RAM) 13, a memory unit 14, and the like. The CPU 11 is a control subject. The ROM 12 stores various programs and data. The memory unit 14 stores various programs. The CPU 11, the ROM 12, the RAM 13, and the memory unit 14 are connected to each other via a bus 15. The CPU 11, the ROM 12, and the RAM 13 constitute a control unit 100. That is, the control unit 100 performs control processing relating to the POS terminal 1 described later by the CPU 11 operating in accordance with a control program stored in the ROM 12 or the memory unit 14 and loaded into the RAM 13.

The RAM 13 is provided with a commodity information unit 131. The commodity information unit 131 stores the commodity information (e.g., commodity code, commodity name, commodity price, and the like) processed for sales registration based on the commodity code specifying the commodity acquired from a code read by a code reader 27.

The memory unit 14 is a nonvolatile memory such as a flash memory or a hard disk drive (HDD) that holds stored information even if the power is turned off. The memory unit 14 is provided with a control program unit 141 and a commodity master 142.

The control program unit 141 stores a control program for controlling the POS terminal 1. The commodity master 142 stores commodity information relating to each commodity that is associated with the commodity code.

In addition, the control unit 100 is connected to an operation unit 21, an operator display unit 22, a customer display unit 23, a printer 24, a card reading unit 25, and the code reader 27 via the bus 15 and a controller 16. In response to an instruction from the control unit 100, the controller 16 controls the operation unit 21, the operator display unit 22, the customer display unit 23, the printer 24, the card reading unit 25, and the code reader 27. Hereinafter, for the convenience of description, control that is performed by the controller 16 is referred to as control that is performed by the control unit 100.

The operation unit 21 is a keyboard provided with a key such as a register key for entering numbers and a settlement key 211 for declaring an end of sales registration. The operator display unit 22 is, for example, a liquid crystal display or the like, and displays the commodity information, the settlement information, and the like to an operator. The customer display unit 23 is, for example, the liquid crystal display device or the like, and displays the commodity information, the settlement information, and the like to the customer.

The printer 24 draws out a roll-shaped receipt paper stored in a main body, prints the commodity information, the settlement information, and the like with a thermal printer having, for example, a thermal transfer type thermal head 241 (refer to FIG. 2), and issues the receipt paper as a receipt. The details will be described later with reference to FIG. 2. The card reading unit 25 reads card information from a card such as a credit card of the customer. The code reader 27 is, for example, a handy type code reader. The code reader 27 optically reads a code attached to a commodity or a discount coupon using visible light such as a laser. The code reader 27 may read a code by cutting out a code from an image captured by an imaging unit (not illustrated).

In addition, the control unit 100 is connected to a communication unit 26 via the bus 15. The communication unit 26 is connected to another POS terminal 1 installed in the store or a store server (not illustrated) connected to the POS terminal 1 via a communication line (not illustrated). The store server receives the commodity information and the settlement information from each POS terminal 1 and performs sales management of the commodity at the store.

Figure 2:
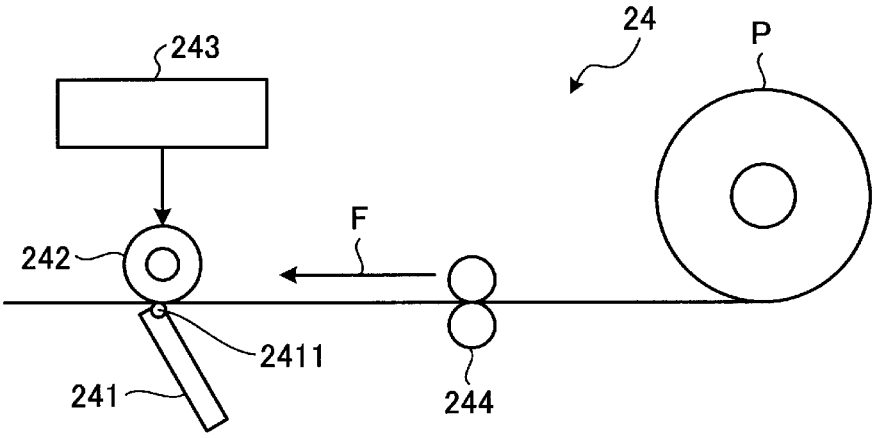
FIG. 2 is a schematic diagram of a printer as laterally viewed.

Next, the printer 24 provided in the POS terminal 1 will be described. FIG. 2 is a schematic diagram of the printer 24 of the POS terminal 1 as laterally viewed. In FIG. 2, the printer 24 is set so that the paper P can be drawn out. The paper P is a paper on which a long thermal paper is wound. In addition, the printer 24 is provided with a thermal head 241, a platen 242, a motor 243, and a roller 244.

The pair of rollers 244 are configured to draw the paper P out by nipping, and convey the paper P that is drawn out toward the thermal head 241.

In the thermal head 241, multiple heating elements 2411 aligned in one line in a direction orthogonal to the conveying direction of the paper P are disposed. The thermal head 241 generates heat by energizing each of the heating elements 2411. The heat generated by the heating element 2411 is transferred to the paper P, so that the paper P is discolored and printing is performed. Printing control of the thermal head 241 will be described later with reference to FIGS. 4, 5, and FIGS. 8 to 10.

The platen 242 is provided at a position facing the heating element 2411 of the thermal head 241. The platen 242 is formed in columnar shaped in the depth direction, and is formed of a rubber-like material, for example. The thermal head 241 is biased toward the platen 242. The platen 242 is in contact with the thermal head 241 at a position where the heating element 2411 is provided. The platen 242 is rotated by being driven by the motor 243 serving as a stepping motor, for example, and conveys the nipped paper P in the direction of an arrow F. In this state, the thermal head 241 generates heat in the heating element 2411 and performs printing on the nipped paper P.

Figure 3:
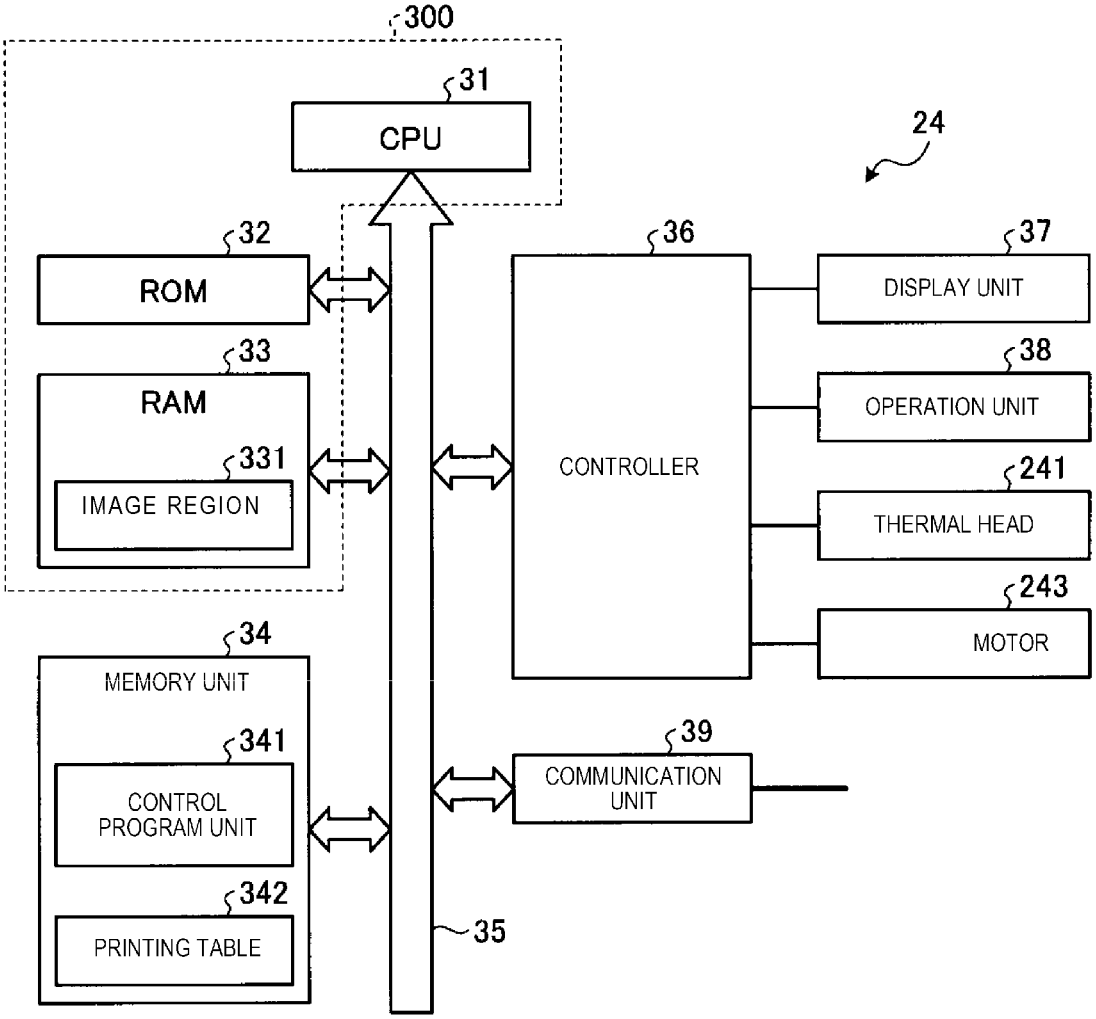
FIG. 3 is a block diagram illustrating a hardware configuration of the printer.

FIG. 3 is a block diagram illustrating a hardware configuration of the printer 24. As illustrated in FIG. 3, the printer 24 is provided with a CPU 31, a ROM 32, a RAM 33, a memory unit 34, and the like. The CPU 31 is a control subject. The ROM 32 stores various programs. The RAM 33 stores programs and various data. The memory unit 34 stores various programs. The CPU 31, the ROM 32, the RAM 33, and the memory unit 34 are connected to each other via a bus 35. The CPU 31, the ROM 32, and the RAM 33 constitute a control unit 300. That is, the control unit 300 performs control processing relating to the printer 24 described later by the CPU 31 operating in accordance with a control program stored in the ROM 32 or the memory unit 34 and loaded into the RAM 33.

The RAM 33 is provided with an image region 331. The image region 331 is a region where the print information input from the POS terminal 1 via the controller 16 is stored as a bitmap by the control unit 300.

The memory unit 34 is a nonvolatile memory such as a flash memory or an HDD that holds stored information even if the power is turned off. The memory unit 34 is provided with a control program unit 341 and a printing table 342. The control program unit 341 stores a control program for controlling the printer 24.

Next, the printing table 342 will be described. FIG. 4 is a memory map illustrating a portion of a memory configuration of the printing table 342. The printing table 342 stores information about a conveying speed of the paper P if a figure is printed and an energization time used for printing a character described later in FIGS. 5 and 6. That is, the printing table 342 is provided with a paper conveying speed column 3421 and an energization time column 3422. The paper conveying speed column 3421 stores two different conveying speeds. A first one is constant speed 1 (4 inch per second (hereinafter, referred to as "ips")) of the paper P when a code such as a bar code or a two-dimensional code serving as one of the figures is printed. A second one is constant speed 2 (2 ips) of the paper P when a pattern such as a logo or coupon serving as one of the figures different from the code is printed. The constant speed 1 and the constant speed 2 are slower than a conveying speed when only the character is printed, which is somewhere between 10 ips and 18 ips. In addition, since the pattern is a figure having multiple gradations, the constant speed 2 is set to be slower than the constant speed 1.

In addition, the energization time column 3422 stores the energization time associated with the constant speed 1 and the constant speed 2. In the constant speed 1, the energization time to the heating element 2411 corresponding to a region H1, where the character is printed, out of the multiple heating elements 2411 is T1 (refer to FIG. 5). An energization time T1 is shorter than the energization time TC, by 50% to 70%, that is applied to the heating element 2411 corresponding to a region H2, where the code is printed, out of the multiple heating elements 2411. In addition, in the constant speed 2, the energization time applied to the heating element 2411 in the region H1, where the character is printed, out of the multiple heating elements 2411 is T2 (refer to FIG. 5). An energization time T2 is shorter than the energization time TZ, by 30% to 50%, that is applied to the heating element 2411 corresponding to a region H2, where the pattern is printed, out of the multiple heating elements 2411. The energization time T1 and the energization time T2 are almost the same as each other.

The description is returned to the description of FIG. 3. In addition, the control unit 300 is connected to a display unit 37, an operation unit 38, the thermal head 241, and the motor 243 via the bus 35 and a controller 36. In response to an instruction from the control unit 300, the controller 36 controls the display unit 37, the operation unit 38, the thermal head 241, and the motor 243. Hereinafter, for the convenience of description, control that is performed by the controller 36 is referred to as control that is performed by the control unit 100 performs.

In addition, the control unit 300 is connected to the communication unit 39 via the bus 35. The communication unit 39 is connected to the controller 16 via a communication line.

Next, a structure of the thermal head 241 will be described. FIGS. 5 and 6 are explanatory diagrams illustrating the structure of the thermal head and a printing region. As illustrated in FIG. 5, the thermal head 241 has multiple heating elements 2411 aligned in a line. Each heating element 2411 generates heat individually. The heating element 2411 generates heat over a width H, and performs printing on the region within the width of the paper P. Specifically, the width H is divided into a region of width H1 (hereinafter, referred to as region H1) and a region of width H2 (hereinafter, referred to as region H2), and the control unit 300 performs the same control for each region. That is, the control unit 300 supplies the same amount of electric power (for example, energization at the same energization time or application of the same voltage) to the heating elements 2411 existing in the region H1. In the embodiment, the same amount of electric power is supplied to each heating element 2411 by energizing the region H1 for the same time. Similarly, the control unit 300 supplies the same amount of electric power to the heating elements 2411 existing in the region H2 by energizing each of the heating elements 2411 for the same time. In the embodiment, the amount of electric power to be supplied by the control unit 300, to the region H1 and to the region H2 may be same or different.

In the example of FIG. 5, only the character is printed in both of the region H1 and the region H2. Therefore, the control unit 300 supplies power of the same amount of electric power to the region H1 and the region H2. That is, the voltage is applied to all the heating elements 2411 for the same time to cause a current to flow. In FIG. 5, a conveying speed of the paper P is determined according to the number of dots formed by the character printed in a block B where the thermal head 241 prints a predetermined number of dots in the conveying direction of the paper P. That is, if the number of dots to be printed in the block B is small, the conveying speed of the paper P is increased. On the other hand, if the number of dots to be printed in the block B is large, the conveying speed of the paper P becomes slow. The conveying speed of the paper P normally varies approximately from 10 ips to 18 ips.

The example of FIG. 6 is a diagram illustrating if the character is printed in the region H1 and the code is simultaneously printed in the region H2. In this case, the control unit 300 refers to the printing table 342 and sets the conveying speed of the paper P in the block B. In the example of FIG. 6, a constant speed 1 which is slower than the conveying speed at which only the character is printed is set. In addition, the energization time of the region H1 in the block B is set to T1. That is, the printer 24 conveys the paper P at the constant speed 1 in the block B, and energizes the heating element 2411 for the energization time T1 to print the character in the region H1 in the block B. On the other hand, for the region H2, the code is printed by energizing for the energization time TC longer than the energization time T1.

Figure 7:
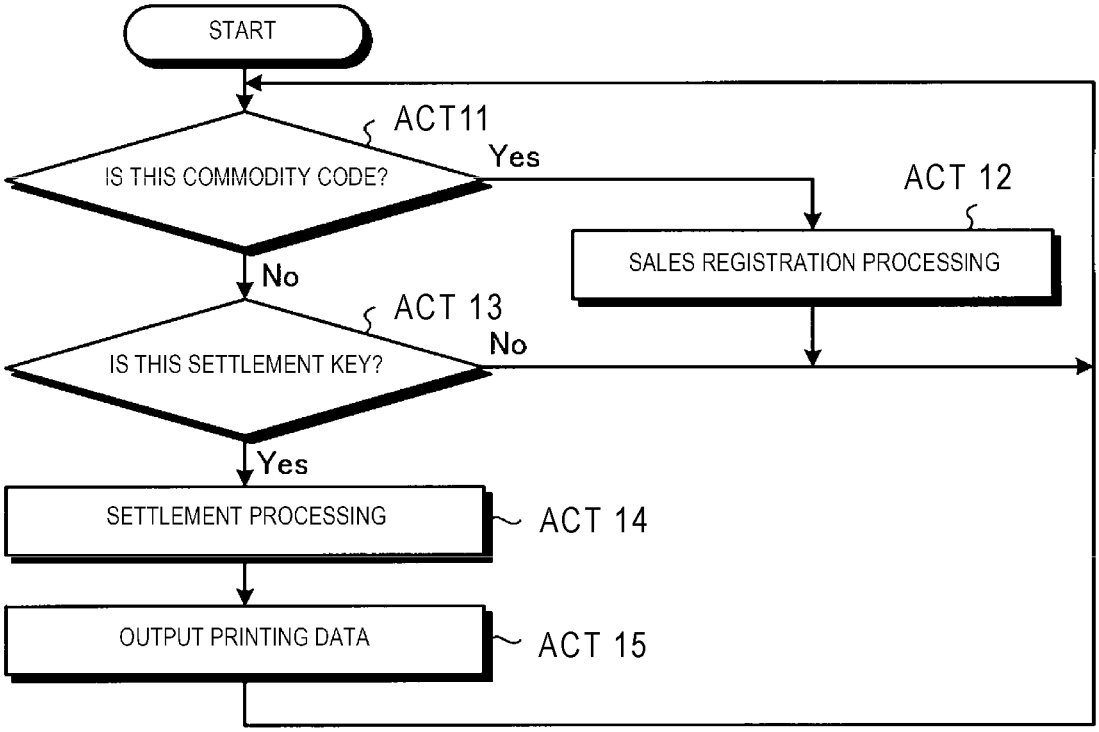
FIG. 7 is a flowchart of control processing of the POS terminal.

Hereinafter, the control processing of the POS terminal 1 will be described. FIG. 7 is a flowchart of control processing of the POS terminal 1. As illustrated in FIG. 7, the code reader 27 reads the code attached to the commodity, so that it is determined whether or not the control unit 100 of the POS terminal 1 inputs a commodity code specifying the commodity (Act 11). If it is determined that the commodity code is entered (Yes in Act 11), the control unit 100 searches the commodity master 142 based on the input commodity code, reads the commodity information of the commodity and stores the commodity information in the commodity information unit 131 (Act 12). The control unit 100 returns to Act 11. For all commodities to be purchased, the control unit 100 repeats the processing of Act 11 and Act 12.

On the other hand, if it is determined that the commodity code is not input (No in Act 11), the control unit 100 determines whether or not the settlement key 211 is operated (Act 13). If it is determined that the settlement key 211 is operated (Yes in Act 13), the control unit 100 performs settlement processing based on the commodity information stored in the commodity information unit 131 (Act 14). The control unit 100 outputs a printing data relating to the commodity information and the settlement information to the printer 24 (Act 15). The control unit 100 returns to Act 11.

The printing data is a command representing character information relating to the commodity information and the settlement information. In addition, the printing data may include data for printing a code such as a bar code and a two-dimensional code, a command indicating the code, data indicating the printing position of the code, and the like. In addition, the printing data may include data for printing a pattern such as a coupon ticket, a command representing the pattern, data indicating a printing position of the pattern, and the like.

If it is determined that it is not an operation of the settlement key 211 (No in Act 13), the control unit 100 returns to Act 11.

Figure 8:
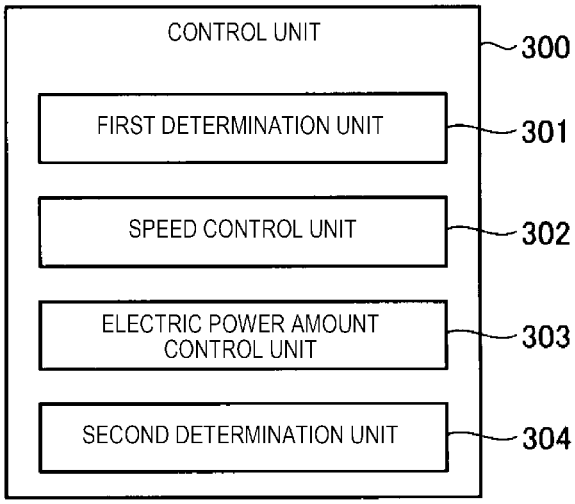
FIG. 8 is a functional block diagram of the printer.

Hereinafter, control from the printer 24 will be described. FIG. 8 is a functional block diagram of the printer 24. The control unit 300 functions as a first determination unit 301, a speed control unit 302, an electric power amount control unit 303, and a second determination unit 304 by following the control program stored in the ROM 32 or the control program unit 341 of the memory unit 34.

The first determination unit 301 has a function of determining whether or not to simultaneously print the character and the figure using the thermal head 241.

The speed control unit 302 has a function of conveying the conveying speed of the paper P at a constant speed which is slower than the conveying speed when only the character is printed, if it is determined that the first determination unit 301 simultaneously controls to print the character and the figure.

The electric power amount control unit 303 has a function of performing printing by reducing the amount of electric power to be supplied to the first region H1 where the character is printed to be smaller than the amount of electric power to be supplied to the second region H2 where the figure is printed, if it is determined that the first determination unit 301 simultaneously controls to print the character and the figure.

The second determination unit 304 has a function of determining whether the figure is a code represented by a symbol or a pattern with gradation.

Figure 9:
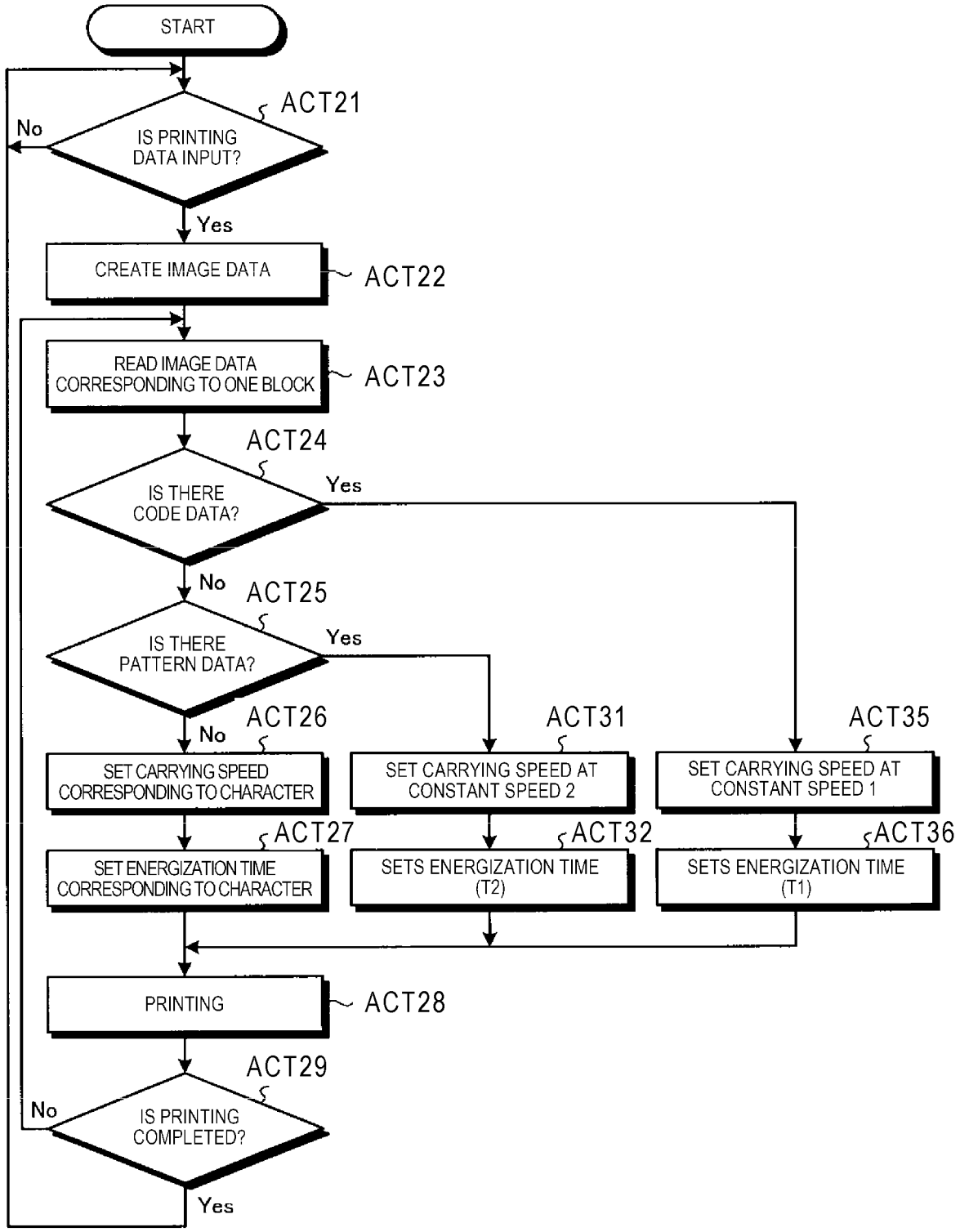
FIG. 9 is a flowchart of control processing of the printer.

FIG. 9 is a flowchart of control processing of the printer 24. As illustrated in FIG. 9, the control unit 300 determines whether or not printing data is input from the controller 16 of the POS terminal 1 (Act 21). The control unit 300 waits until the printing data is input (No in Act 21), and it is determined that the printing data is input (Yes in Act 21), the control unit 300 creates image data for printing on the paper P based on the input printing data (Act 22). The image data is data obtained by generating data for printing on the paper P as a bitmap data, and is data of an aggregate of dots. The printing on the paper P is performed by printing the dots with the thermal head 241. The control unit 300 stores the created image data in the image region 331. At this stage, the control unit 300 recognizes at which position the data relating to the character is created, at which position the data relating to the code is created, and at which position the data relating to the pattern is created based on a command representing the input code or pattern.

Next, the control unit 300 reads the image data corresponding to one block of the block obtained by dividing the image data stored in the image region 331 into predetermined blocks (Act 23). The first determination unit 301 and the second determination unit 304 determine whether or not code data representing a code is included in the read image data (Act 24). If it is determined that the code data is included (Yes in Act 24), the control unit 300 reads out the conveying speed (4 ips) of constant speed 1 from the paper conveying speed column 3421 of the printing table 342. The speed control unit 302 sets the read conveying speed in the RAM 33 (Act 35).

Next, the control unit 300 reads an energization time T1 for printing the character from the energization time column 3422. The electric power amount control unit 303 sets the read energization time in the RAM 33 (Act 36). The speed control unit 302 and electric power amount control unit 303) control printing of the code while conveying the paper P at the constant speed 1 (Act 28). At that time, the control unit 300 energizes for the energization time TC to print the code. In addition, the control unit 300 energizes for the energization time T1 that is shorter than the energization time TC and controls printing of the character. Next, the control unit 300 determines whether or not printing of all the image data is completed (Act 29). In addition, if image data to be printed still exists in the image region 331 (No in Act 29), the control unit 300 returns to Act 23 and reads the image data corresponding to the next block. On the other hand, if it is determined that printing of all of the image data is completed (Yes in Act 29), the control unit 300 controls issuing of the printed receipt and returns to Act 21.

In addition, if it is determined that the code data is not included (No in Act 24), the first determination unit 301 and second determination unit 304 determine whether or not the read image data includes pattern data representing a pattern (Act 25). If it is determined that the pattern data is included (Yes in Act 25), the control unit 300 reads the conveying speed (2 ips) at the constant speed 2 from the paper conveying speed column 3421 of the printing table 342. The speed control unit 302 sets the read conveying speed in the RAM 33 (Act 31). Next, the control unit 300 reads the energization time T2 for printing the character from the energization time column 3422. The electric power amount control units 303 sets the read energization time in the RAM 33 (Act 32). The control unit 300 prints the pattern while conveying the paper P at the set constant speed 2 (Act 28). At that time, the control unit 300 energizes for the energization time TZ to print the pattern. In addition, the control unit 300 energizes for the energization time T2 that is shorter than the energization time TZ to print the character. The control unit 300 performs the processing of Act 29.

In addition, if it is determined that the pattern data is not included (No in Act 25), the control unit 300 calculates the conveying speed of the paper P necessary for printing only the character. The control unit 300 calculates the conveying speed of the paper P according to the number of dots as the image data in the block B. The control unit 300 sets the calculated conveying speed of the paper P in the RAM 33 (Act 26). Next, the control unit 300 sets a predetermined energization time for printing only the character (Act 27).

The control unit 300 sets the time to be equivalent to the energization time T1 or the energization time T2. The control unit 300 controls printing of the character while conveying the paper P at the set conveying speed (Act 28). The control unit 300 performs the processing of Act 29.

Figure 10:
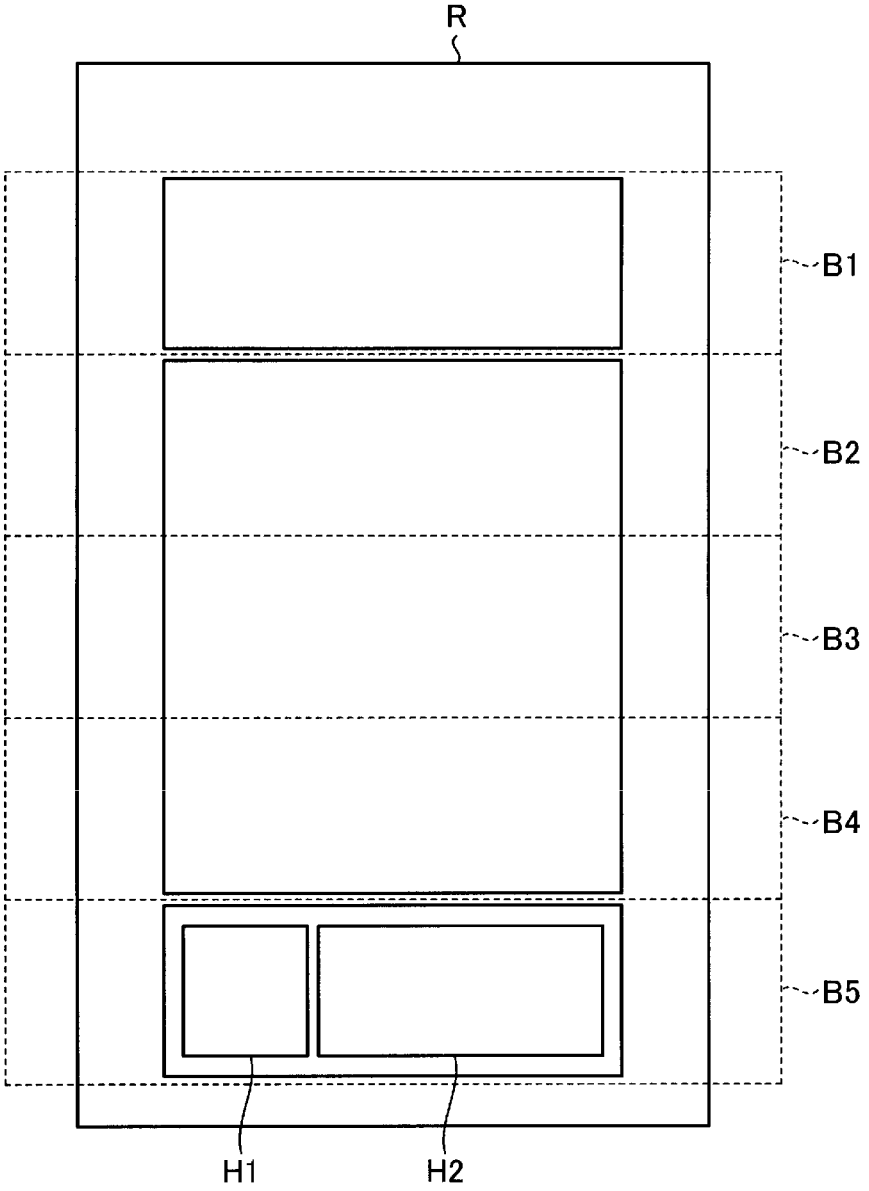
FIG. 10 is an explanatory diagram illustrating a printing example of a receipt in the printer.

Here, the relationship between the state of printing processed by the control unit 300 and the issued receipt will be described. FIG. 10 is an explanatory diagram illustrating a printing example of a receipt in the printer. As illustrated in FIG. 10, when the receipt R is printed, the control unit 300 performs printing processing by dividing into five blocks from B1 to B5. Since a logo of a company is printed on the block B1, the control unit 300 carries the paper P at the constant speed 2. In addition, the control unit 300 energizes for the energization time TZ, and controls printing of the pattern existing in the region H2.

Subsequently, the control unit 300 controls printing on the block B2. Only the character data exists in the block B2. Therefore, the control unit 300 sets the conveying speed of the paper P based on the number of dots representing the character existing in the block B2, and performs printing by energizing for a predetermined energization time. Since the block B3 and the block B4 have only the character data, the control unit 300 performs the same processing as that of the block R2.

On the block B5, the character data in the region H1 and the code data in the region H2 are respectively printed.

Therefore, the control unit 300 carries the paper P at the constant speed 1. In addition, the control unit 300 energizes for the energization time T1 and controls printing of the character existing in the region H1. In addition, the control unit 300 energizes for the energization time TC and controls printing of the code existing in the region H2.

According to the present embodiment as such, when printing the code or the pattern, the energization time for printing the character can be set short. Therefore, power consumption while printing the code or the pattern can be suppressed without supplying excessive electric power to the printing of the character to be simultaneously printed when printing the code or the pattern. In addition, since excessive power is not supplied to print the character, the character can be prevented from blurring due to excessive application of heat.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the amount of electric power is suppressed by controlling the energization time to the heating element 2411 to be short when the character is printed. However, by setting the voltage to be applied to the heating element 2411 for printing the character to be low, the amount of electric power may be suppressed.

In addition, the printer 24 incorporated in the POS terminal 1 is described as a printer. However, the printer 24 may be a device which is different from the POS terminal 1, provided outside the POS terminal 1, and connected to the POS terminal 1 via a communication line.

A program executed by the printer 24 is provided by being recorded on a computer-readable recording medium such as a CD-ROM, a flexible disk (FD), a CD-R, a digital versatile disk (DVD).

In addition, a program executed by the printer 24 may be configured to be stored on a computer connected to a network such as the Internet and provided by being downloaded via the network. In addition, the program executed by the printer 24 may be provided or distributed via a network such as the Internet.

In addition, the program executed by the printer 24 may be configured to be incorporated in advance in ROM or the like and provided.

What is claimed is:

1. A printer comprising:

a thermal head having a plurality of heating elements to print on a paper that is conveyed thereto;

a controller configured to control a speed of the paper that is conveyed and an amount of power supplied to the heating elements; and a processor configured to determine from image data of an image that is to be printed on the paper using the thermal head whether or not a character and a figure other than the character are to be simultaneously printed and instruct the controller based on the determination, wherein the processor instructs the controller to set the speed of the paper to a first speed which is slower than a second speed, which is the speed for printing the character without the figure, upon determining that the character and the figure are to be simultaneously printed.

2. The printer according to claim 1, wherein the processor instructs the controller to supply power to first heating elements facing a first region of the paper on which the character is to be printed for a first time period and to second heating elements facing a second region of the paper on which the figure is to be printed for a second time period that is longer than the first time period.

3. The printer according to claim 1, wherein the processor instructs the controller to reduce a voltage to be applied to first heating elements facing a first region of the paper on which the character is to be printed, to a first voltage that is lower than a second voltage to be applied to second heating elements facing a second region of the paper on which the figure is to be printed.

4. The printer according to claim 1, wherein the processor is configured to determine from the image data whether or not the figure determined to be simultaneously printed with the character includes a pattern with gradation, and the processor instructs the controller to set the speed of the paper to a third speed which is slower than the first speed upon determining that the figure includes a pattern with gradation.

5. The printer according to claim 1, wherein the image data includes a plurality of blocks, and upon determining that the character and the figure are to be simultaneously printed, the processor instructs the controller to set the speed of the paper for a time period that is long enough to print one of the blocks.

6. The printer according to claim 5, wherein the blocks are equal sized and are arranged one after another in a conveyance direction of the paper.

7. The printer according to claim 6, wherein the processor determines for each block whether or not a character and a figure other than the character are included therein.

8. A printer comprising:

a thermal head having a plurality of heating elements to print on a paper that is conveyed thereto;

a controller configured to control a speed of the paper that is conveyed and an amount of power supplied to the heating elements; and a processor configured to determine from image data of an image that is to be printed on the paper using the thermal head whether or not a character and a pattern with gradation are to be simultaneously printed and instruct the controller based on the determination, wherein the processor instructs the controller to set the speed of the paper to a first speed which is slower than a second speed, which is the speed for printing the character without the pattern with degradation, upon determining that the character and the figure are to be simultaneously printed.

9. The printer according to claim 8, wherein the first speed is slower than a third speed, which is the speed for printing a code.

10. The printer according to claim 9, wherein the third speed is slower than the first speed.

11. The printer according to claim 8, wherein the processor instructs the controller to supply power to first heating elements facing a first region of the paper on which the character is to be printed for a first time period and to second heating elements facing a second region of the paper on which the pattern with gradation is to be printed for a second time period that is longer than the first time period.

12. The printer according to claim 11, wherein the second time period is longer than a third time period, which is the time period for supplying power to heating elements facing a third region of the paper if a code is to be printed in the third region.

13. The printer according to claim 12, wherein the third time period is longer than the first time period.

14. The printer according to claim 8, wherein the processor instructs the controller to reduce a voltage to be applied to first heating elements facing a first region of the paper on which the character is to be printed, to a first voltage that is lower than a second voltage to be applied to second heating elements facing a second region of the paper on which the pattern with gradation is to be printed.

15. The printer according to claim 8, wherein the image data includes a plurality of blocks, and upon determining that the character and the pattern with gradation are to be simultaneously printed, the processor instructs the controller to set the speed of the paper for a time period that is long enough to print one of the blocks.

16. The printer according to claim 15, wherein the blocks are equal sized and are arranged one after another in a conveyance direction of the paper.

17. The printer according to claim 16, wherein the processor determines for each block whether or not a character and a pattern with gradation are included therein.

18. A method of controlling a printer with a thermal head having a plurality of heating elements to print on a paper that is conveyed thereto, said method comprising:

determining from image data of an image that is to be printed on the paper using the thermal head whether or not a character and a figure other than the character are to be simultaneously printed; and upon determining that the character and the figure are to be simultaneously printed, setting a conveyance speed of the paper to a first speed which is slower than a second speed, which is the speed for printing the character without the figure.

19. The method according to claim 18, further comprising:

supplying power to first heating elements facing a first region of the paper on which the character is to be printed for a first time period and to second heating elements facing a second region of the paper on which the figure is to be printed for a second time period that is longer than the first time period.

20. The method according to claim 18, further comprising:

reducing a voltage to be applied to first heating elements facing a first region of the paper on which the character is to be printed, to a first voltage that is lower than a second voltage to be applied to second heating elements facing a second region of the paper on which the figure is to be printed.

* * * * *